US009849558B2

(12) United States Patent
Nakayama et al.

(10) Patent No.: US 9,849,558 B2
(45) Date of Patent: Dec. 26, 2017

(54) POLISHING PAD DRESSER, POLISHING APPARATUS AND POLISHING PAD DRESSING METHOD

(71) Applicant: TOSHIBA MEMORY CORPORATION, Minato-ku (JP)

(72) Inventors: Takayuki Nakayama, Yokkaichi (JP); Dai Fukushima, Kuwana (JP)

(73) Assignee: TOSHIBA MEMORY CORPORATION, Minato-ku (JP)

( * ) Notice: Subject to any disclaimer, the term of this patent is extended or adjusted under 35 U.S.C. 154(b) by 237 days.

(21) Appl. No.: 14/735,245

(22) Filed: Jun. 10, 2015

(65) Prior Publication Data

US 2016/0243672 A1 Aug. 25, 2016

(30) Foreign Application Priority Data

Feb. 20, 2015 (JP) ..... 2015-032012

(51) Int. Cl.
*B24B 53/00* (2006.01)
*B24B 53/017* (2012.01)
*B24B 37/04* (2012.01)

(52) U.S. Cl.
CPC ..... *B24B 53/017* (2013.01); *B24B 37/04* (2013.01)

(58) Field of Classification Search
CPC ..... B24B 53/017; B24B 37/04
USPC ..... 451/56, 443
See application file for complete search history.

(56) References Cited

U.S. PATENT DOCUMENTS 6,439,986 B1 8/2002 Myoung et al.
6,500,054 B1 * 12/2002 Ma ..... B24B 37/26 451/443
6,709,730 B2 * 3/2004 Nishibayashi ..... C30B 33/00 428/141
6,905,398 B2 * 6/2005 Jeong ..... B24B 41/047 451/259
6,945,857 B1 * 9/2005 Doan ..... B24B 53/12 451/443
7,510,463 B2 * 3/2009 Kim ..... B24B 53/017 451/443
9,132,526 B2 * 9/2015 Smith ..... B24B 53/017
9,457,450 B2 * 10/2016 Chung ..... B24B 53/053
2004/0053567 A1 * 3/2004 Henderson ..... B24B 53/017 451/287
2004/0180617 A1 * 9/2004 Goers ..... B24B 53/017 451/443
2007/0037493 A1 * 2/2007 Shih ..... B24D 18/0027 451/56
2007/0066194 A1 * 3/2007 Wielonski ..... B24B 53/017 451/443

(Continued)

FOREIGN PATENT DOCUMENTS

JP 10-058307 3/1998
JP 2003-511255 3/2003

(Continued)

*Primary Examiner* — George Nguyen
(74) *Attorney, Agent, or Firm* — Oblon, McClelland, Maier & Neustadt, L.L.P.

(57) ABSTRACT

In one embodiment, a polishing pad dresser includes a first base portion, and first convex portions provided in a first region of the first base portion. Furthermore, a width of the first convex portions is 1 to 10 μm, a height of the first convex portions is 0.5 to 10 μm, and a density of the first convex portions in the first region is 0.1 to 50%.

20 Claims, 12 Drawing Sheets

(56) References Cited

U.S. PATENT DOCUMENTS

| | | | | |
|---|---|---|---|---|
| 2009/0075567 | A1* | 3/2009 | Wang | B24B 53/017 451/56 |
| 2009/0239454 | A1* | 9/2009 | Yamashita | B24B 53/017 451/443 |
| 2009/0325472 | A1* | 12/2009 | Wu | B24B 37/205 451/443 |
| 2010/0248595 | A1* | 9/2010 | Dinh-Ngoc | B24B 37/04 451/56 |
| 2011/0201260 | A1* | 8/2011 | Hosali | B24B 53/007 451/56 |
| 2011/0250826 | A1* | 10/2011 | Yoon | B24B 53/12 451/443 |
| 2012/0302146 | A1* | 11/2012 | Sung | B24B 53/017 451/443 |
| 2014/0099868 | A1* | 4/2014 | Sung | B24B 53/017 451/56 |
| 2014/0154960 | A1* | 6/2014 | Lee | B24B 53/12 451/443 |
| 2015/0004787 | A1* | 1/2015 | Hung | B24B 53/017 438/692 |
| 2015/0027063 | A1* | 1/2015 | Tai | B24B 53/017 51/298 |

FOREIGN PATENT DOCUMENTS

| | | |
|---|---|---|
| JP | 2004-291129 | 10/2004 |
| JP | 2006-55944 | 3/2006 |
| JP | 2007-44824 | 2/2007 |

* cited by examiner

POLISHING PAD DRESSER, POLISHING APPARATUS AND POLISHING PAD DRESSING METHOD

CROSS REFERENCE TO RELATED APPLICATION

This application is based upon and claims the benefit of priority from the prior Japanese Patent Application No. 2015-32012, filed on Feb. 20, 2015, the entire contents of which are incorporated herein by reference.

FIELD

Embodiments described herein relate to a polishing pad dresser, a polishing apparatus and a polishing pad dressing method.

BACKGROUND

When a semiconductor device is manufactured, a film on a substrate is often polished to planarize the film or to make the film thinner. For example, such polishing is performed with a chemical mechanical polishing (CMP) apparatus. However, when the semiconductor device with a large vertical dimension such as a three-dimensional memory is manufactured, such polishing performed with an existing CMP apparatus takes long time of approximately 100 seconds. Therefore, a technique is required in which a polishing target such as the film on the substrate can be polished faster.

DETAILED DESCRIPTION

Embodiments will now be explained with reference to the accompanying drawings.

In one embodiment, a polishing pad dresser includes a first base portion, and first convex portions provided in a first region of the first base portion. Furthermore, a width of the first convex portions is 1 to 10 μm, a height of the first convex portions is 0.5 to 10 μm, and a density of the first convex portions in the first region is 0.1 to 50%.

First Embodiment

Figure 1:
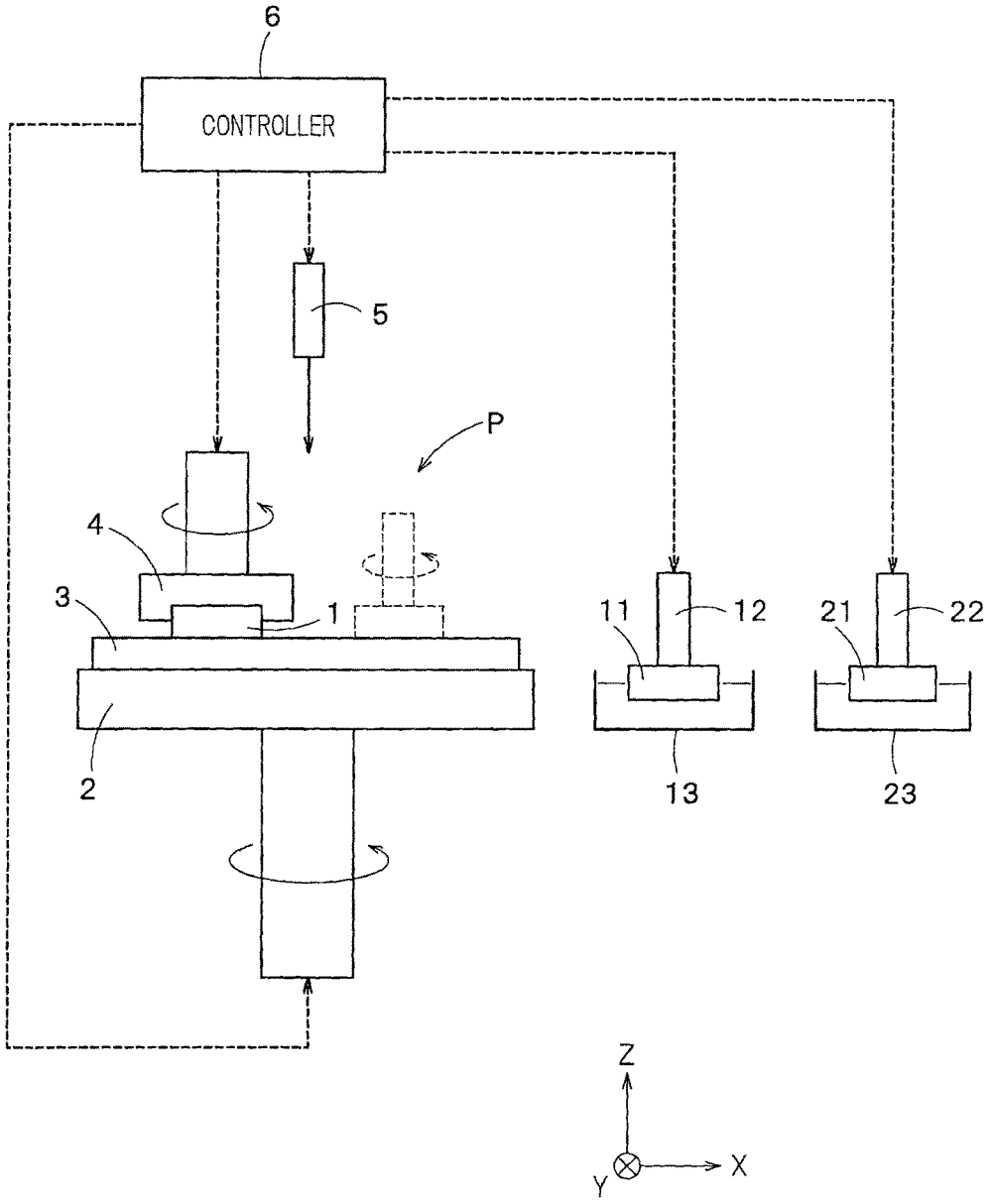
FIG. 1 is a cross-sectional view illustrating a structure of a polishing apparatus of a first embodiment.

FIG. 1 is a cross-sectional view illustrating a structure of a polishing apparatus of a first embodiment.

The polishing apparatus in FIG. 1 is a CMP apparatus for polishing a wafer (substrate) 1 by CMP. The polishing apparatus in FIG. 1 includes a surface plate 2, a polishing pad 3, a polishing head 4, a slurry feeder 5, a controller 6, a first polishing pad dresser 11, a first arm 12, a first standby module 13, a second polishing pad dresser 21, a second arm 22 and a second standby module 23.

FIG. 1 illustrates an X-direction and a Y-direction which are parallel to a placing surface of the polishing apparatus and perpendicular to each other, and a Z-direction perpendicular to the placing surface of the polishing apparatus. In the specification, the +Z-direction is regarded as an upward direction and the −Z-direction is regarded as a downward direction. For example, positional relation between the wafer 1 and the surface plate 2 is expressed as that the surface plate 2 is positioned below the wafer 1. The −Z-direction of the present embodiment may coincide with the direction of gravity or may not coincide with the direction of gravity.

The polishing head 4 holds the wafer 1 which is a polishing target, and the surface plate 2 holds the polishing pad 3 which is a polishing member. The polishing apparatus causes the wafer 1 to rotate with the polishing head 4, causes the polishing pad 3 to rotate with the surface plate 2, and feeds slurry on the surface of the polishing pad 3 from the slurry feeder 5. The polishing apparatus then brings the wafer 1 into contact with the polishing pad 3 using the polishing head 4 to press the wafer 1 on the polishing pad 3. In this way, the surface of the wafer 1 is polished by the polishing pad 3. Operations of the surface plate 2, the polishing head 4 and the slurry feeder 5 are controlled by the controller 6. The controller 6 controls various operations of the polishing apparatus.

The first and second polishing pad dressers 11 and 21 are used for dressing the surface of the polishing pad 3. The dressing can improve or recover the performance of the polishing pad 3.

The first polishing pad dresser 11 is held by the first arm 12. When the wafer 1 is polished by the polishing pad 3, the first polishing pad dresser 11 is standing by in the state where it is immersed in water inside the first standby module 13. When the polishing pad 3 is dressed by the first polishing pad dresser 11, the first arm 12 moves the first polishing pad dresser 11 to the position of the arrow P, rotates the first polishing pad dresser 11, and presses the first polishing pad dresser 11 on the polishing pad 3. In this way, the surface of the polishing pad 3 is dressed by the first polishing pad dresser 11. The operation of the first arm 12 is controlled by the controller 6.

The second polishing pad dresser 21 is held by the second arm 22. When the wafer 1 is polished by the polishing pad 3, the second polishing pad dresser 21 is standing by in the state where it is immersed in water inside the second standby module 23. When the polishing pad 3 is dressed by the second polishing pad dresser 21, the second arm 22 moves the second polishing pad dresser 21 to the position of the arrow P, rotates the second polishing pad dresser 21, and presses the second polishing pad dresser 21 on the polishing pad 3. In this way, the surface of the polishing pad 3 is dressed by the second polishing pad dresser 21. The operation of the second arm 22 is controlled by the controller 6.

Figure 2A:
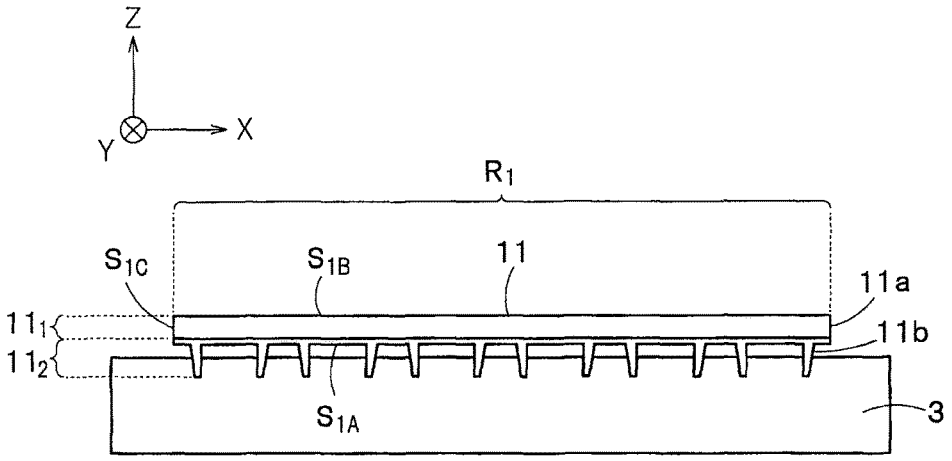
FIGS. 2A and 2B are cross-sectional views illustrating a structure of a first polishing pad dresser of the first embodiment.
Figure 2B:
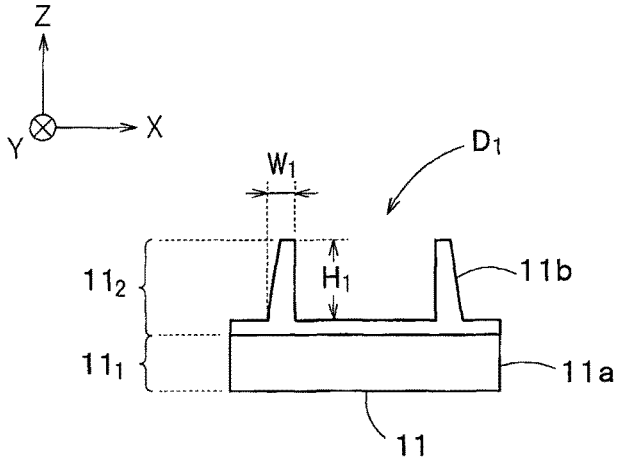

FIGS. 2A and 2B are cross-sectional views illustrating a structure of the first polishing pad dresser 11 of the first embodiment.

FIG. 2A is a cross-sectional view illustrating the first polishing pad dresser 11 in dressing the polishing pad 3. FIG. 2B is an expanded sectional view in which the frontside-to-backside direction of the first polishing pad dresser 11 is reversed.

As illustrated in FIG. 2A, the first polishing pad dresser 11 includes a base portion 11*a* and convex portions 11*b* provided on the base portion 11*a*. The convex portions 11*b* of the present embodiment are edge patterns protruding from a surface of the base portion 11*a*. The first polishing pad dresser 11 dresses the polishing pad 3 with these convex portions 11*b*. The base portion 11*a* is an example of a first base portion. The convex portions 11*b* are an example of first convex portions.

A part of the base portion 11*a* is formed of a first material $\mathbf{11}_1$. The remaining part of the base portion 11*a* and the convex portions 11*b* are formed of a second material $\mathbf{11}_2$ different from the first material $\mathbf{11}_1$. In this manner, the convex portions 11*b* of the present embodiment are formed of the same material as a portion of the base portion 11*a*. Alternatively, the convex portions 11*b* of the present embodiment may be formed of the same material as the entirety of the base portion 11*a*.

The convex portions 11*b* are desirable to be formed of a hard material because they are used for dressing the polishing pad 3. Examples of the material of the convex portions 11*b* are a Si-based material containing silicon (Si), a Ti-based material containing titanium (Ti), an Al-based material containing aluminum (Al) and the like. Specifically, the convex portions 11*b* are oxides, nitrides or carbides containing Si, Ti or Al. Examples of the material of the convex portions 11*b* are silicon (Si), silicon oxide ($SiO_2$), silicon nitride (SiN), silicon carbide (SiC), titanium nitride (TiN), aluminum oxide ($Al_2O_3$) and the like.

The base portion 11*a* has a first surface $S_{1A}$, a second surface $S_{1B}$, and an end face $S_{1C}$ between the first and second surfaces $S_{1A}$ and $S_{1B}$. The convex portions 11*b* are provided in a region $R_1$ corresponding to the first surface $S_{1A}$ of the base portion 11*a*. The region $R_1$ is an example of a first region.

FIG. 2B illustrates a width $W_1$ of the convex portions 11*b*, a height $H_1$ of the convex portions 11*b*, and a density $D_1$ of the convex portions 11*b* in the region $R_1$. The width $W_1$ of the convex portions 11*b* of the present embodiment is set to be 1 to 10 μm (1 μm≤$W_1$≤10 μm). The height $H_1$ of the convex portions 11*b* of the present embodiment is set to be 0.5 to 10 μm (0.5 μm≤$H_1$≤10 μm). The density $D_1$ of the convex portions 11*b* in the region $R_1$ of the present embodiment is set to be 0.1 to 50% (0.1%≤$D_1$≤50%).

The density $D_1$ of the present embodiment is calculated by dividing the total area of the convex portions 11*b* in the region $R_1$ by the area of the region $R_1$ and expressing it in percentage. It is noted that these areas represent the areas of the region $R_1$ and the convex portions 11*b* in the XY-plane. The area of the region $R_1$ of the present embodiment represents the area of the first surface $S_{1A}$ and is expressed by $\pi r_1^2$ where $r_1$ is the radius of the first surface $S_{1A}$.

Figure 3A:
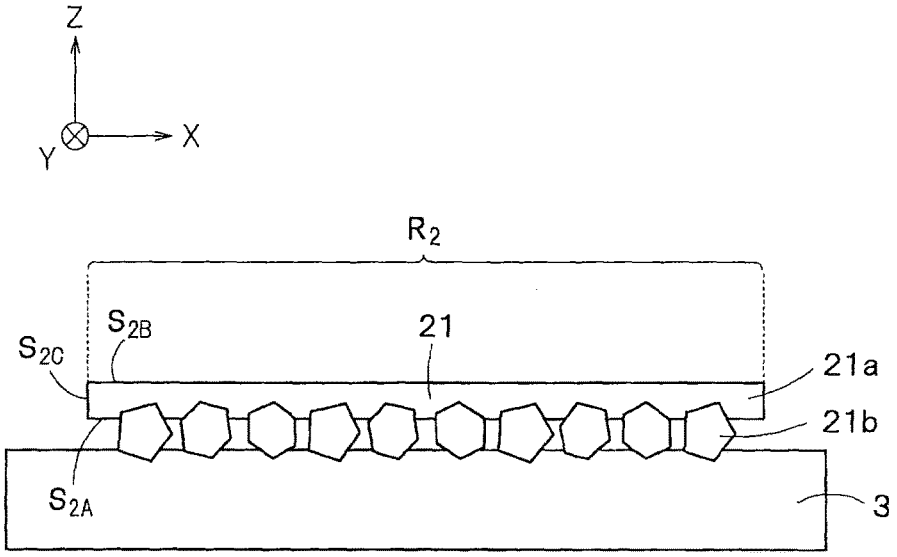
FIGS. 3A and 3B are cross-sectional views illustrating a structure of a second polishing pad dresser of the first embodiment.
Figure 3B:
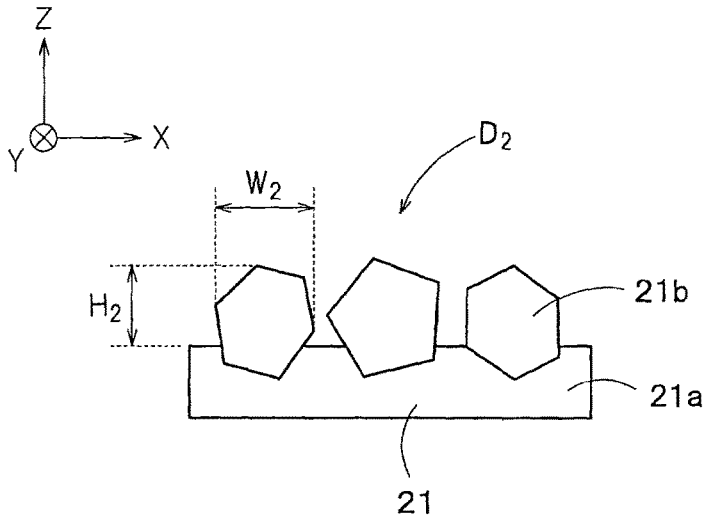

FIGS. 3A and 3B are cross-sectional views illustrating a structure of the second polishing pad dresser 21 of the first embodiment.

FIG. 3A is a cross-sectional view illustrating the second polishing pad dresser 21 in dressing the polishing pad 3. FIG. 3B is an expanded sectional view in which the frontside-to-backside direction of the second polishing pad dresser 21 is reversed.

As illustrated in FIG. 3A, the second polishing pad dresser 21 includes a base portion 21*a* and convex portions 21*b* provided on the base portion 21*a*. The convex portions 21*b* of the present embodiment are diamond particles attached onto a surface of the base portion 21*a*. In this manner, the convex portions 21*b* of the present embodiment are formed of diamond. The second polishing pad dresser 21 dresses the polishing pad 3 with these convex portions 21*b*.

The base portion 21*a* has a first surface $S_{2A}$, a second surface $S_{2B}$, and an end face $S_{2C}$ between the first and second surfaces $S_{2A}$ and $S_{2B}$. The convex portions 21*b* are provided in a region $R_2$ corresponding to the first surface $S_{2A}$ of the base portion 21*a*.

FIG. 3B illustrates a width $W_2$ of the convex portions 21*b*, a height $H_2$ of the convex portions 21*b*, and a density $D_2$ of the convex portions 21*b* in the region $R_2$. The width $W_2$ of the convex portions 21*b* of the present embodiment is set to be greater than 10 μm ($W_2$>10 μm), for example, 100 to 200 μm. The height $H_2$ of the convex portion 21*b* of the present embodiment is set to be greater than 10 μm ($H_2$>10 μm), for example, 100 to 200 μm. The density $D_2$ of the convex portions 21*b* in the region $R_2$ of the present embodiment is set to be higher than 50% ($D_2$>50%).

The density $D_2$ of the present embodiment is calculated by dividing the total area of the convex portions 21*b* in the region $R_2$ by the area of the region $R_2$ and expressing it in percentage. It is be noted that these areas represent the areas of the region $R_2$ and the convex portions 21*b* in the XY-plane. The area of the region $R_2$ of the present embodiment represents the area of the first surface $S_{2A}$ and is expressed by $\pi r_2^2$ where $r_2$ is the radius of the first surface $S_{2A}$.

As described above, the first polishing pad dresser 11 of the present embodiment includes fine convex portions 11*b* whose width $W_1$ and height $H_1$ are 10 μm or less, and the second polishing pad dresser 21 of the present embodiment includes course convex portions 21*b* whose width $W_2$ and height $H_2$ exceed 10 μm. Moreover, the density $D_1$ of the convex portions 11*b* in the first polishing pad dresser 11 of the present embodiment is set to be 50% or less so that the convex portions 11*b* are arranged sparse, and the density $D_2$ of the convex portions 21*b* in the second polishing pad dresser 21 of the present embodiment is set higher than 50% so that the convex portions 21*b* is arranged dense.

Figure 4A:
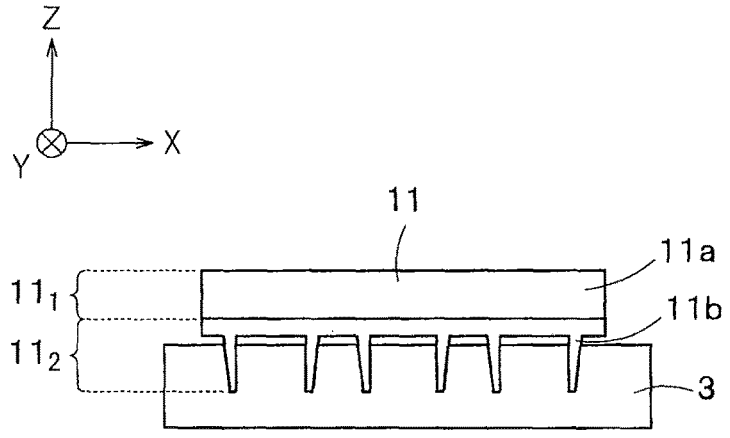
FIGS. 4A to 4C are cross-sectional views illustrating an example of usage of the first polishing pad dresser of the first embodiment.
Figure 4B:
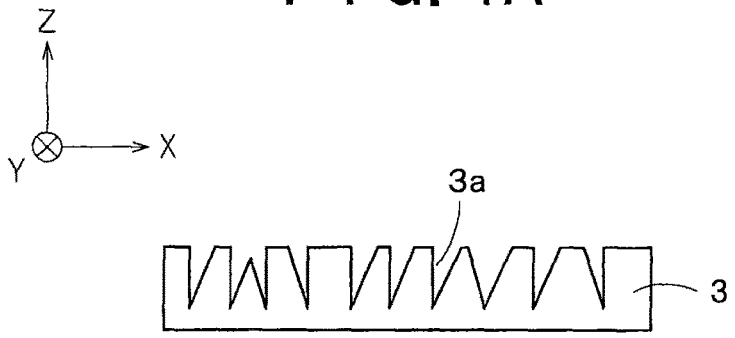
Figure 4C:
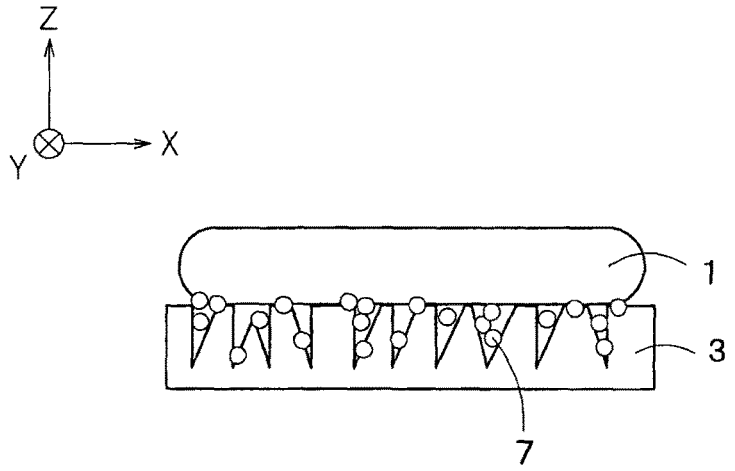

FIGS. 4A to 4C are cross-sectional views illustrating an example of usage of the first polishing pad dresser 11 of the first embodiment.

FIG. 4A illustrates the first polishing pad dresser 11 in dressing the polishing pad 3. Since the first polishing pad dresser 11 of the present embodiment includes the fine and low-density convex portions 11*b*, it can form fine scratches 3*a* on the surface of the polishing pad 3 by dressing the polishing pad 3 (FIG. 4B).

FIG. 4C illustrates polishing of the wafer 1 using the polishing pad 3 which has been dressed by the first polishing pad dresser 11. Sign 7 designates slurry particles fed from the slurry feeder 5. The slurry particles 7 come into the scratches 3*a* of the polishing pad 3. The slurry particles 7 which have got into the scratches 3*a* contribute to improvement of the polishing rate of the wafer 1 with the polishing pad 3. Therefore, the present embodiment makes it possible, by dressing the polishing pad 3 with the first polishing pad dresser 11, to enhance the polishing rate compared to that before the dressing.

Figure 5A:
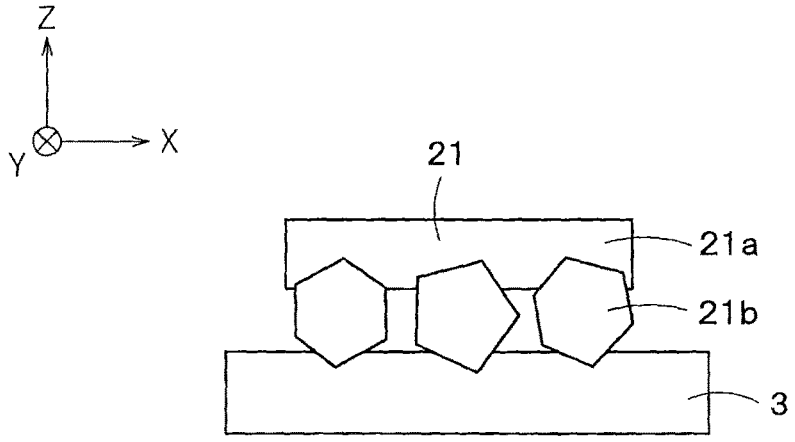
FIGS. 5A to 5C are cross-sectional views illustrating an example of usage of the second polishing pad dresser of the first embodiment.
Figure 5B:
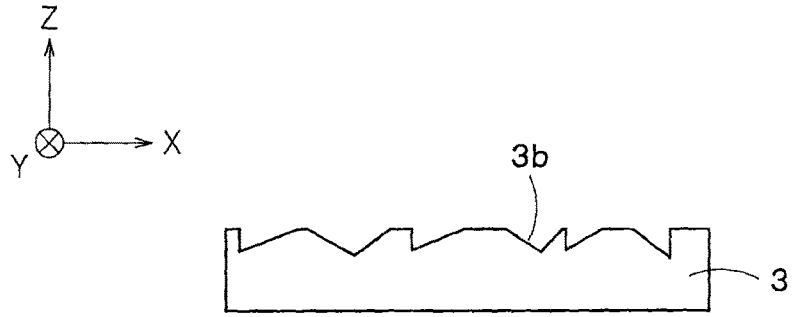
Figure 5C:
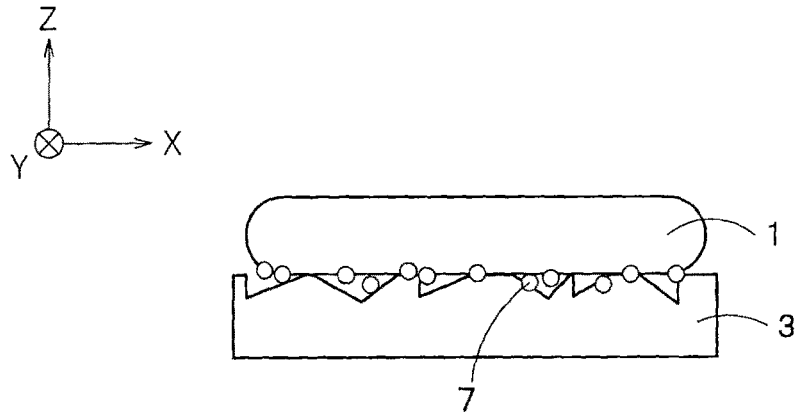

FIGS. 5A to 5C are cross-sectional views illustrating an example of usage of the second polishing pad dresser 21 of the first embodiment.

FIG. 5A illustrates the second polishing pad dresser 21 in dressing the polishing pad 3. Since the second polishing pad dresser 21 of the present embodiment includes the course and high-density convex portions 21*b*, it can form coarse scratches 3*b* on the surface of the polishing pad 3 by dressing the polishing pad 3 (FIG. 5B).

FIG. 5C illustrates polishing of the wafer 1 using the polishing pad 3 which has been dressed by the second polishing pad dresser 21. Sign 7 designates the slurry particles fed from the slurry feeder 5. The slurry particles 7 come into the scratches 3*b* of the polishing pad 3. The slurry particles 7 which have got into the scratches 3*b* contribute to improvement of the polishing rate of the wafer 1 with the polishing pad 3. Therefore, the present embodiment makes it possible, by dressing the polishing pad 3 with the second polishing pad dresser 21, to enhance the polishing rate compared with that before the dressing.

In the present embodiment, the polishing pad 3 dressed by the first polishing pad dresser 11 has the fine scratches 3*a*, and the polishing pad 3 dressed by the second polishing pad dresser 21 has the coarse scratches 3*b*. Therefore, it is considered that the slurry particles 7 are more liable to be trapped in the scratches 3*a* than in the scratches 3*b*. Accordingly, the polishing rate of the polishing pad 3 can be enhanced more in the case of using the polishing pad 3 dressed by the first polishing pad dresser 11 of the present embodiment than in the case of using the polishing pad 3 dressed by the second polishing pad dresser 21.

The second polishing pad dresser 21 is normally used in dressing the polishing pad 3 of the present embodiment. Meanwhile, the first polishing pad dresser 11 is used when the polishing rate of the polishing pad 3 is desired to be largely improved. For example, the second polishing pad dresser 21 is used when low protrusions are desired to be removed by the polishing. On the other hand, the first polishing pad dresser 11 is used when high protrusions are desired to be removed by the polishing. In this manner, the first and second polishing pad dressers 11 and 21 in the present embodiment can be separately used depending on the intended purpose.

The scratches 3*a* by the first polishing pad dresser 11 are finer than the scratches 3*b* by the second polishing pad dresser 21. Therefore, the present embodiment makes it possible, by dressing the polishing pad 3 with the first polishing pad dresser 11, to reduce the abrasion amount of the polishing pad 3 compared with the case of dressing the polishing pad 3 with the second polishing pad dresser 21. Therefore, the present embodiment can extend the operation life of the polishing pad 3.

Figure 6:
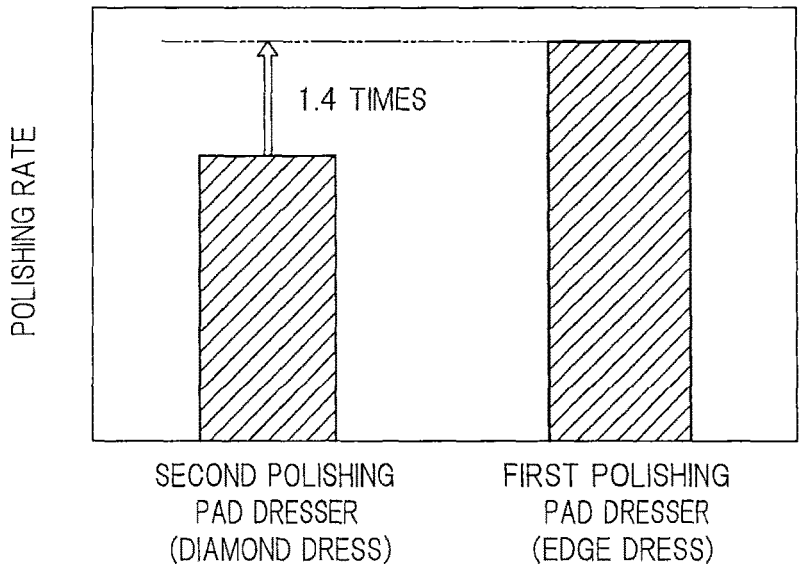
FIG. 6 is a graph illustrating measurement results of polishing rates of a wafer by using a polishing pad of the first embodiment.

FIG. 6 is a graph illustrating measurement results of polishing rates of the wafer 1 by using the polishing pad 3 of the first embodiment.

FIG. 6 presents the polishing rate in the case of using the polishing pad 3 dressed by the first polishing pad dresser 11 (edge dressing), and the polishing rate in the case of using the polishing pad 3 dressed by the second polishing pad dresser 21 (diamond dressing). From the measurement results in FIG. 6, it is understood that the polishing rate in the case of using the first polishing pad dresser 11 increases by 1.4 times compared with the polishing rate in the case of using the second polishing pad dresser 21.

FIGS. 7A to 7F are plan views illustrating examples of layout for the convex portions 11*b* of the first polishing pad dresser 11 of the first embodiment.

Figure 7A:
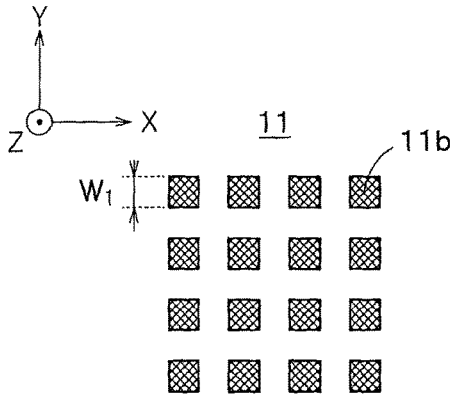
FIGS. 7A to 7F are plan views illustrating examples of layout for convex portions of the first polishing pad dresser of the first embodiment.

Each of the convex portions 11*b* in FIG. 7A has a square planar shape and has a columnar shape extending in the Z-direction. The width $W_1$ of these convex portions 11*b* is the length of one side of the square.

Figure 7D:
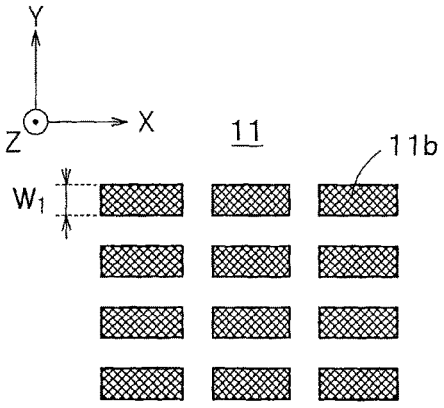
Figure 7B:
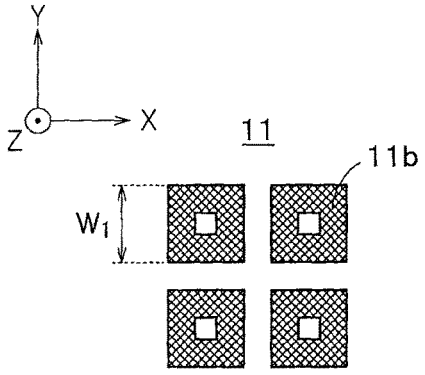

Each of the convex portions 11*b* in FIG. 7B has an annular planar shape and has a tubular shape extending in the Z-direction. The inner circumference and the outer circumference of the annular shape are square. The width $W_1$ of these convex portions 11*b* is the length of one side of the outer circumferential square. Each convex portion 11*b* in FIG. 7B has a shape having four convex portions 11*b* in FIG. 7A connected to one another, and has approximately 8 times the volume of each convex portion 11*b* in FIG. 7A. The width $W_1$ of the convex portions 11*b* in FIG. 7B is approximately 3 times the width $W_1$ of the convex portions 11*b* in FIG. 7A.

Figure 7E:
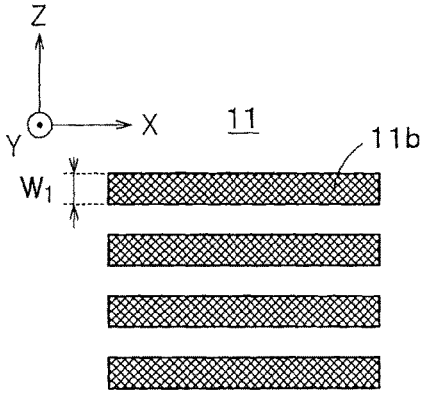
Figure 7C:
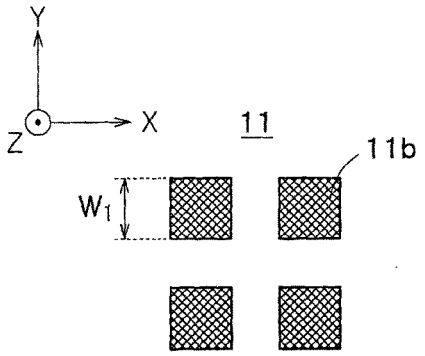

Each convex portion 11*b* in FIG. 7C has a shape in which a center cavity of each convex portion 11*b* in FIG. 7B is closed. Therefore, each of the convex portions 11*b* in FIG. 7C has a square planar shape and has a columnar shape extending in the Z-direction. The width $W_1$ of these convex portions 11*b* is the length of one side of the square. It is noted that the length of one side of the square in FIG. 7C is reduced to be ⅔ times the length of one side of the outer circumferential square in FIG. 7B. Therefore, the width $W_1$ of the convex portions 11*b* in FIG. 7C is approximately twice the width $W_1$ of the convex portions 11*b* in FIG. 7A. Each convex portion 11*b* in FIG. 7C has approximately 4 times the volume of each convex portion 11*b* in FIG. 7A.

In the case where a convex portion 11*b* has a columnar shape, the planar shape of the convex portion 11*b* may be other than square. Similarly, in the case where a convex portion 11*b* has a tubular shape, the inner circumferential and outer circumferential planar shapes of the convex portion 11*b* may be other than square. Moreover, the layout of the convex portions 11*b* is not limited to the examples in FIGS. 7A to 7C. For example, the convex portions 11*b* may be arranged in a triangular grid instead of being arranged in a rectangular grid. Other examples of the convex portions 11*b* of the present embodiment are illustrated in FIGS. 7D to 7F.

The convex portions 11*b* in FIGS. 7D and 7E have strip planar shapes extending in the X-direction. The width $W_1$ of these convex portions 11*b* is the length of the short side of the strip shapes. The width $W_1$ of the convex portions 11*b* in FIGS. 7D and 7E is herein set to be approximately the same as the width $W_1$ of the convex portions 11*b* in FIG. 7A.

Figure 7F:
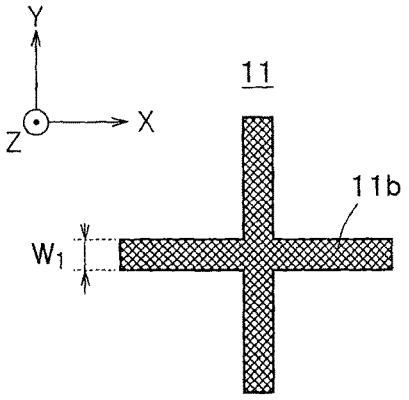

Each of the convex portions 11*b* in FIG. 7F has a cross planar shape containing strip portions extending in the X-direction and strip portions extending in the Y-direction. The width $W_1$ of these convex portions 11*b* is the length of the short sides of these strip portions. The width $W_1$ of the convex portions 11*b* in FIG. 7F is set to be approximately the same as the width $W_1$ of the convex portions 11*b* in FIG. 7A.

Figure 8A:
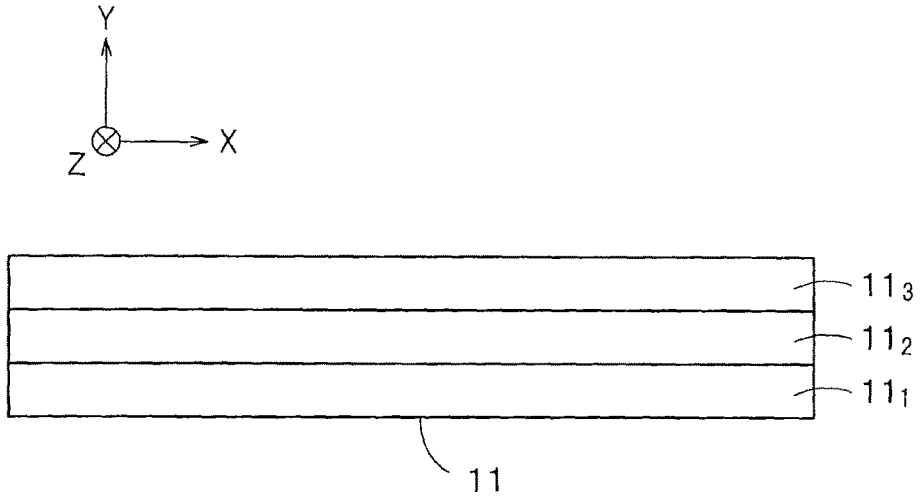
FIGS. 8A to 8C are cross-sectional views illustrating a first example of a method of fabricating the first polishing pad dresser of the first embodiment.
Figure 8B:
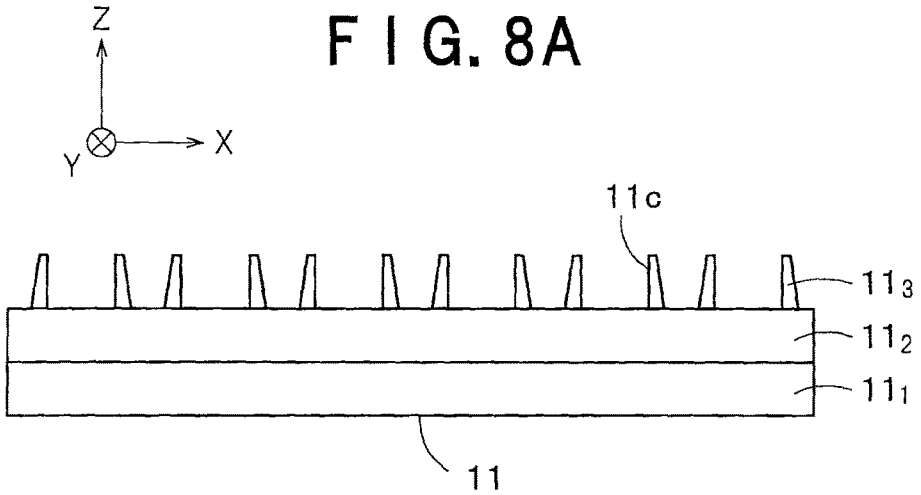
Figure 8C:
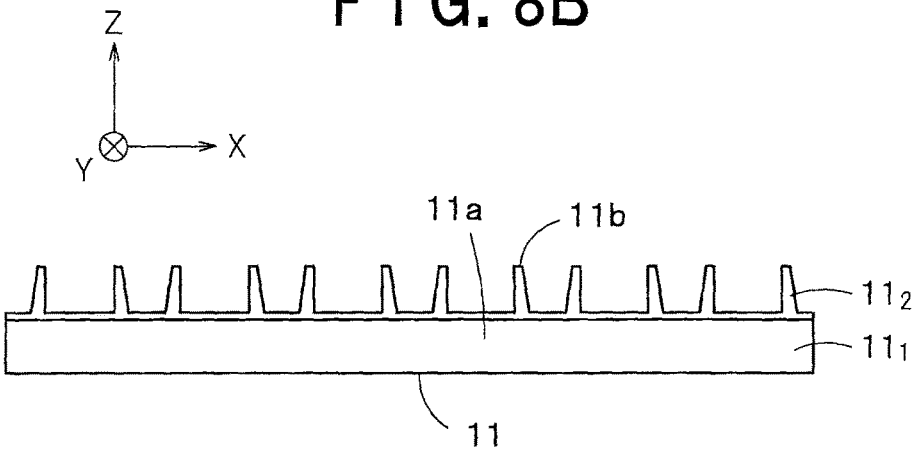

FIGS. 8A to 8C are cross-sectional views illustrating a first example of a method of fabricating the first polishing pad dresser 11 of the first embodiment. In the first example, the first polishing pad dresser 11 is fabricated by semiconductor manufacture processing.

First, the second material $\mathbf{11}_2$ is formed on the first material $\mathbf{11}_1$, and a photoresist film $\mathbf{11}_3$ is formed on the second material $11_2$ (FIG. 8A). Examples of the first material $11_1$ are a semiconductor substrate and an insulating substrate. Examples of the second material $11_2$ are a conductive layer, a semiconductor layer and an insulating layer. The first material $11_1$ or the second material $11_2$ may be a stacked film including plural layers.

Next, the photoresist film $11_3$ is patterned by photolithography and etching (FIG. 8B). As a result, convex portions 11*c* are formed of the photoresist film $11_3$.

Next, the second material $11_2$ is etched by using the photoresist film $11_3$ as a mask (FIG. 8C). As a result, the convex portions 11*c* are transferred onto the second material $11_2$ to form the convex portions 11*b* of the second material $11_2$. In this way, the first polishing pad dresser 11 including the base portion 11*a* and the convex portions 11*b* is fabricated.

The etching in FIG. 8C may be stopped before the first material $11_1$ is exposed, or may be continued until the first material $11_1$ is exposed. In the former case, the base portion 11*a* is to include the first material $11_1$ and a part of the second material $11_2$. In the latter case, the base portion 11*a* is to include only the first material $11_1$. FIG. 8C represents the former case. This is the same as the case in FIGS. 2A and 2B.

The polishing pad dresser 11 of the present embodiment may be formed by forming the photoresist film $11_3$ on the first material $11_1$, patterning the photoresist film $11_3$, and etching the first material $11_1$ by using the photoresist film $11_3$ as a mask. In this case, both of the base portion 11*a* and the convex portions 11*b* are formed of only the first material $11_1$.

Figure 9A:
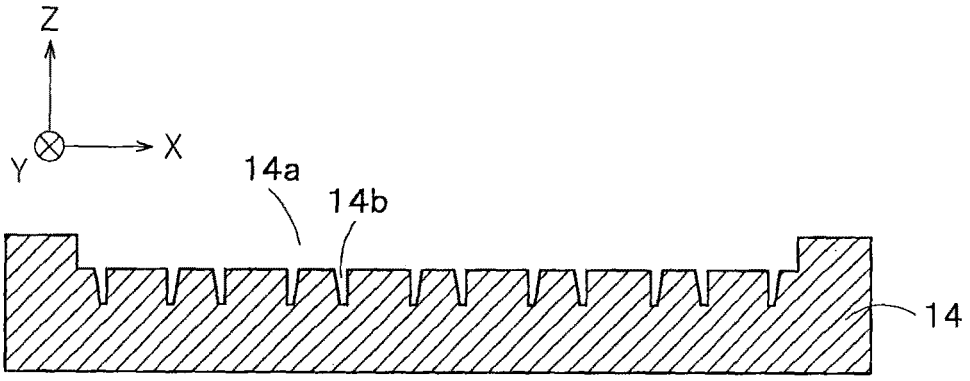
FIGS. 9A to 9C are cross-sectional views illustrating a second example of the method of fabricating the first polishing pad dresser of the first embodiment.
Figure 9B:
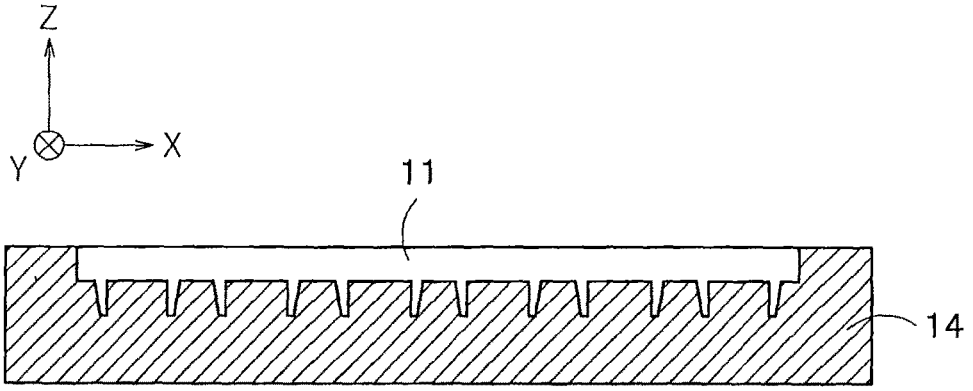
Figure 9C:
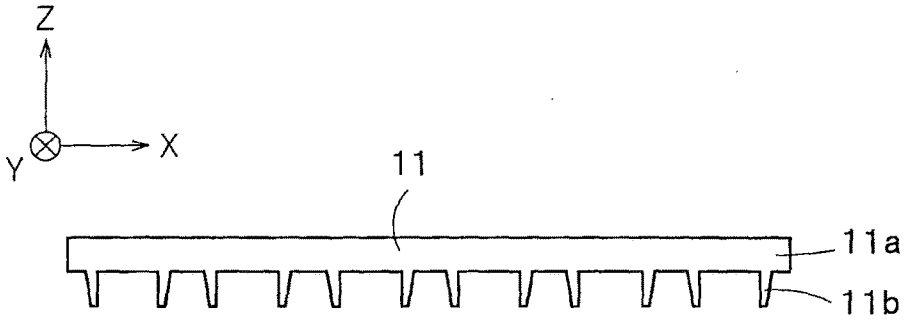

FIGS. 9A to 9C are cross-sectional views illustrating a second example of the method of fabricating the first polishing pad dresser 11 of the first embodiment. In the second example, the first polishing pad dresser 11 is fabricated by metallic molding.

First, a metallic mold 14 having a first opening 14*a* for forming the base portion 11*a* and second openings 14*b* for forming the convex portions 11*b* is prepared (FIG. 9A). The second openings 14*b* are provided at the bottom of the first opening 14*a*.

Next, the material of the first polishing pad dresser 11 is poured into the first and second openings 14*a* and 14*b* (FIG. 9B). In this way, the first polishing pad dresser 11 including the base portion 11*a* and the convex portions 11*b* is fabricated with the metallic mold 14.

Next, the first polishing pad dresser 11 is taken out of the metallic mold 14 (FIG. 9C). In this way, the first polishing pad dresser 11 completes.

As described above, the first polishing pad dresser 11 of the present embodiment includes the fine and low-density convex portions 11*b*. Specifically, the width $W_1$ of the convex portions 11*b* of the present embodiment is set to be 1 to 10 μm, the height $H_1$ of the convex portions 11*b* of the present embodiment is set to be 0.5 to 10 μm, and the density $D_1$ of the convex portions 11*b* in the region $R_1$ of the present embodiment is set to be 0.1 to 50%.

Therefore, the present embodiment can form, by dressing the polishing pad 3 with the first polishing pad dresser 11, the fine scratches 3*a* on the polishing pad 3, which can effectively enhance the polishing rate of the polishing pad 3. Therefore, the present embodiment makes it possible, by using such a polishing pad 3, to enable fast polishing of a polishing target such as the wafer 1.

Second Embodiment

Figure 10:
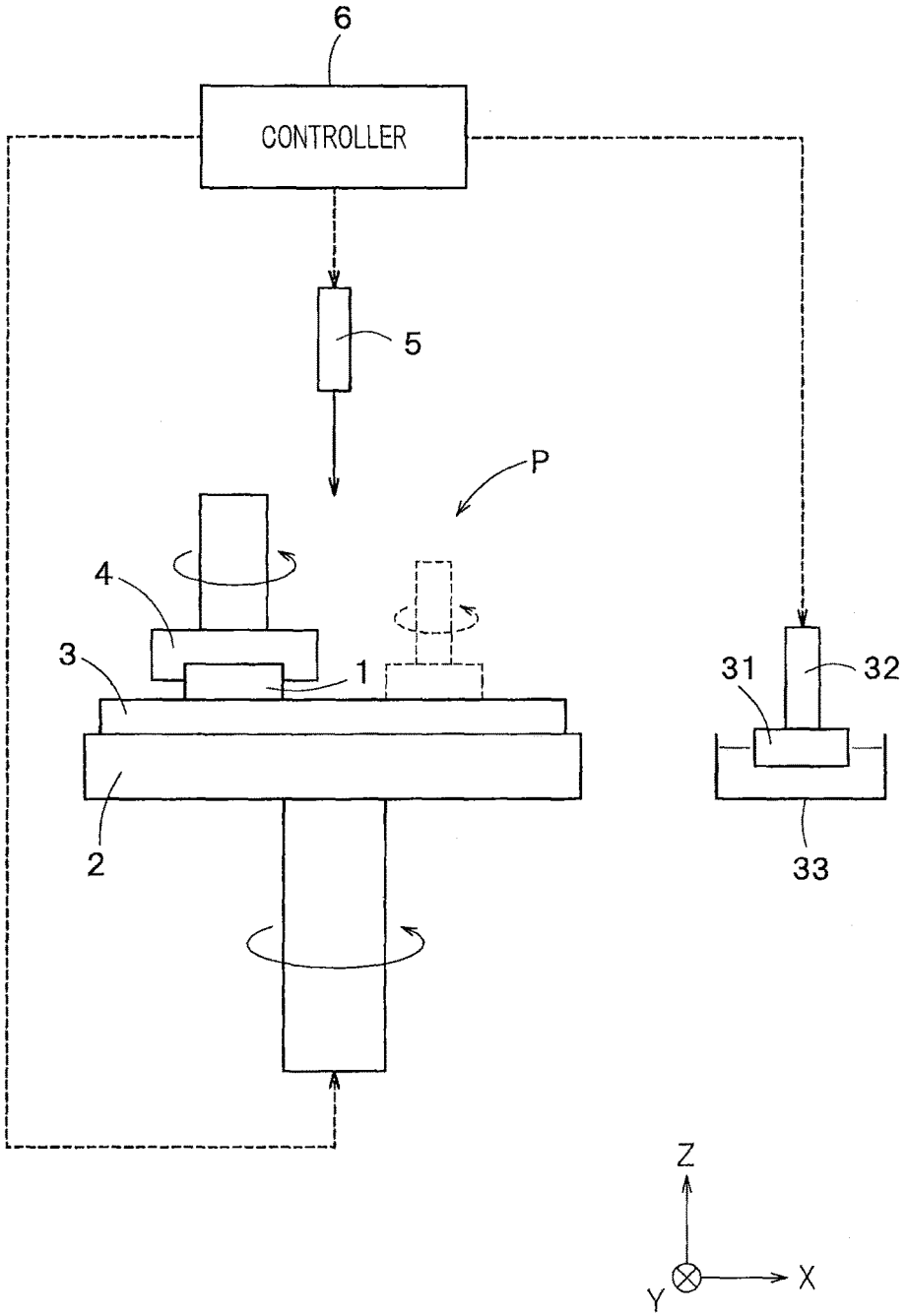
FIG. 10 is a cross-sectional view illustrating a structure of a polishing apparatus of a second embodiment.

FIG. 10 is a cross-sectional view illustrating a structure of a polishing apparatus of a second embodiment. In the description of the second embodiment, explanations on the matters common to those of the first embodiment are omitted.

The polishing apparatus in FIG. 10 includes a polishing pad dresser 31, an arm 32 and a standby module 33 in place of the first polishing pad dresser 11, the first arm 12, the first standby module 13, the second polishing pad dresser 21, the second arm 22 and the second standby module 23.

The polishing pad dresser 31 is used for dressing the surface of the polishing pad 3. The dressing can improve or recover the performance of the polishing pad 3.

The polishing pad dresser 31 is held by the arm 32. When the wafer 1 is polished by the polishing pad 3, the polishing pad dresser 31 is standing by in the state where it is immersed in water inside the standby module 33. When the polishing pad 3 is dressed by the polishing pad dresser 31, the arm 32 moves the polishing pad dresser 31 to the position of the arrow P, rotates the polishing pad dresser 31, and presses the polishing pad dresser 31 on the polishing pad 3. In this way, the surface of the polishing pad 3 is dressed by the polishing pad dresser 31. The operation of the arm 32 is controlled by the controller 6.

Figure 11A:
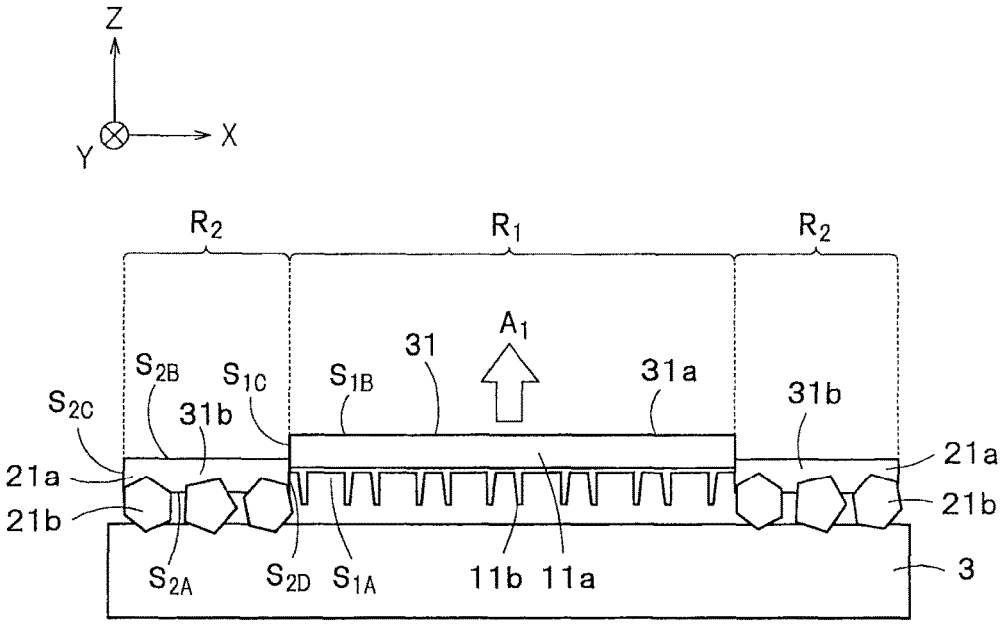
FIGS. 11A and 11B are cross-sectional views illustrating a structure of a polishing pad dresser of the second embodiment.
Figure 11B:
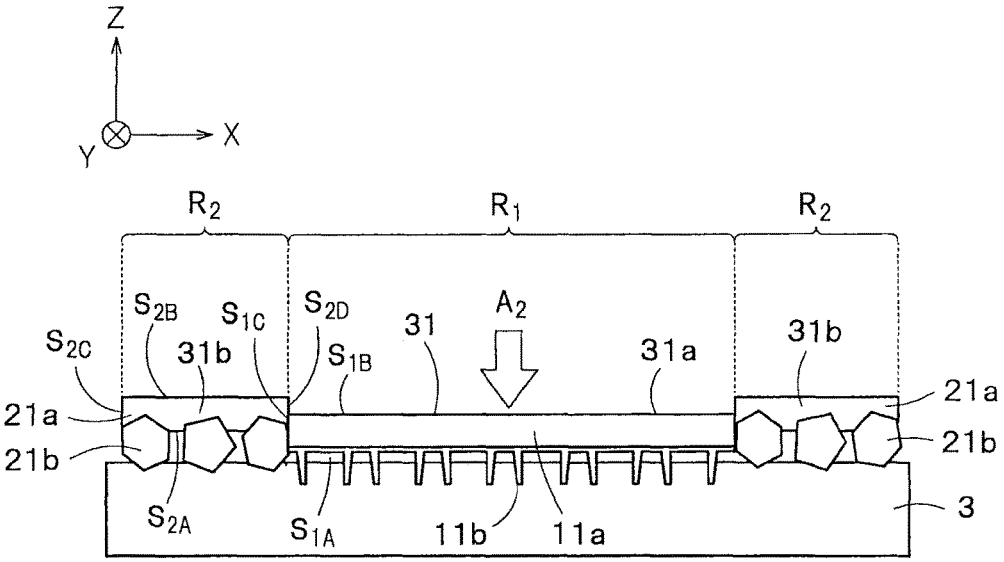

FIGS. 11A and 11B are cross-sectional views illustrating a structure of the polishing pad dresser 31 of the second embodiment.

As illustrated in FIGS. 11A and 11B, the polishing pad dresser 31 includes a first dresser module 31*a*, and a second dresser module 31*b* adjacent to the first dresser module 31*b*. The first dresser module 31*a* of the present embodiment has a circular planar shape. The second dresser module 31*b* of the present embodiment has a circular ring-like planar shape and surrounds the first dresser module 31*a*.

The first dresser module 31*a* is configured to be movable relative to the second dresser module 31*b*, and therefore can move in the vertical direction relative to the second dresser module 31*b* (Z-direction). In FIG. 11A, the first dresser module 31*a* is sucked in the upward direction as indicated by the arrow $A_1$. In FIG. 11B, the first dresser module 31*a* is pressed in the downward direction as illustrated by the arrow $A_2$.

Similarly to the first polishing pad dresser 11 of first embodiment, the first dresser module 31*a* includes the base portion 11*a* and the convex portions 11*b* provided on the base portion 11*a*. Similarly to the first embodiment, the convex portions 11*b* of the present embodiment are edge patterns protruding from the surface of the base portion 11*a*. The first dresser module 31*a* can dress the polishing pad 3 with these convex portions 11*b*. The base portion 11*a* is an example of the first base portion. The convex portions 11*b* are an example of the first convex portions.

The base portion 11*a* has the first surface $S_{1A}$, the second surface $S_{1B}$, and the end face $S_{1C}$ between the first and second surfaces $S_{1A}$ and $S_{1B}$. The convex portions 11*b* are provided in the region $R_1$ corresponding to the first surface $S_{1A}$ of the base portion 11*a*. The region $R_1$ is an example of the first region.

The width $W_1$ of the convex portions 11*b*, the height $H_1$ of the convex portions 11*b*, and the density $D_1$ of the convex portions 11*b* in the region $R_1$ are set similarly to the first embodiment (refer to FIG. 2B). Namely, the width $W_1$ of the convex portions 11*b* is set to be 1 to 10 μm, the height $H_1$ of the convex portions 11*b* is set to be 0.5 to 10 μm, and the density $D_1$ of the convex portions 11*b* in the region $R_1$ is set to be 0.1 to 50%. The density $D_1$ is calculated by dividing the total area of the convex portions 11*b* in the region $R_1$ by the area of the region $R_1$ and expressing it in percentage.

Similarly to the second polishing pad dresser 21 of the first embodiment, the second dresser module 31*b* includes the base portion 21*a* and the convex portions 21*b* provided on the base portion 21*a*. Similarly to the first embodiment, the convex portions 21*b* of the present embodiment are diamond particles attached onto the surface of the base portion 21*a*. The second dresser module 31*b* can dress the polishing pad 3 with these convex portions 21*b*. The base portion 21*a* is an example of a second base portion. The convex portions 21*b* are an example of second convex portions.

The base portion 21*a* has the first surface $S_{2A}$, the second surface $S_{2B}$, an outer end face $S_{2C}$ between the first and second surfaces $S_{2A}$ and $S_{2B}$, and an inner end face $S_{2D}$ between the first and second surface $S_{2A}$ and $S_{2B}$. The base portion 21*a* is adjacent to the base portion 11*a*. The inner end face $S_{2D}$ of the base portion 21*a* is adjacent to the end face $S_{1C}$ of the base portion 11*a*. The convex portions 21*b* are provided in the region $R_2$ corresponding to the first surface $S_{2A}$ of the base portion 21*a*. The region $R_2$ is an example of a second region.

The width $W_2$ of the convex portions 21*b*, the height $H_2$ of the convex portions 21*b*, and the density $D_2$ of the convex portions 21*b* in the region $R_2$ are set similarly to the first embodiment (refer to FIG. 3B). Namely, the width $W_2$ of the convex portions 21*b* is set to be longer than 10 μm, the height $H_2$ of the convex portions 21*b* is set to be greater than 10 μm, and the density $D_2$ of the convex portions 21*b* in the region $R_2$ is set to be higher than 50%. The density $D_2$ is calculated by dividing the total area of the convex portions 21*b* in the region $R_2$ by the area of the region $R_2$ and expressing it in percentage.

The base portion 11*a* (first dresser module 31*a*) is configured to be movable relative to the base portion 21*a* (second dresser module 31*b*), and therefore can move in the vertical direction relative to the base portion 21*a*.

In FIG. 11A, the base portion 11*a* is sucked in the upward direction. As a result, the first surface $S_{1A}$ of the base portion 11*a* is higher than the first surface $S_{2A}$ of the base portion 21*a*. Therefore, the polishing pad dresser 31 in FIG. 11A can dress the polishing pad 3 only with the convex portions 21*b* of the second dresser module 31*b*.

In FIG. 11B, the base portion 11*a* is pressed in the downward direction. As a result, the first surface $S_{1A}$ of the base portion 11*a* is lower than the first surface $S_{2A}$ of the base portion 21*a*. Therefore, the polishing pad dresser 31 in FIG. 11B can dress the polishing pad 3 with the convex portions 11*b* and 21*b* of the first and second dresser modules 31*a* and 31*b* or only with the convex portions 11*b* of the first dresser module 31*a*.

Figure 12A:
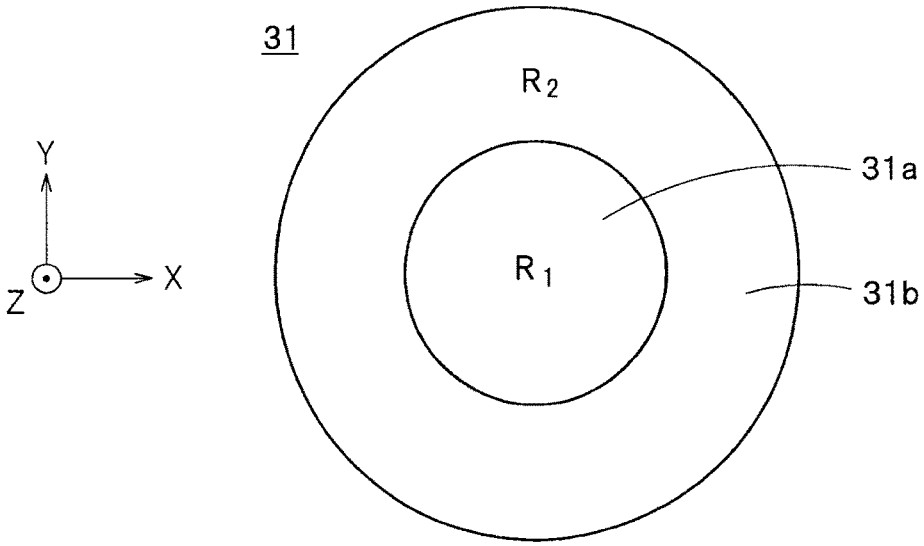
FIGS. 12A and 12B are plan views illustrating structures of the polishing pad dresser of the second embodiment.
Figure 12B:
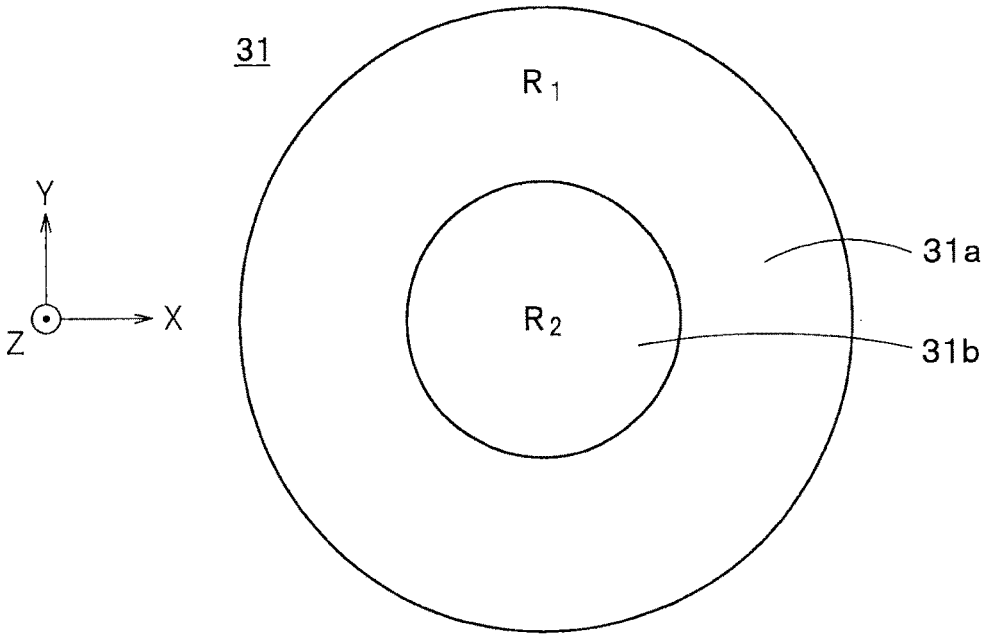

FIGS. 12A and 12B are plan views illustrating structures of the polishing pad dresser 31 of the second embodiment.

In the polishing pad dresser 31 of the present embodiment, the second dresser module 31*b* surrounds the first dresser module 31*a* as illustrated in FIG. 12A. As a result, the second region $R_2$ of the base portion 21*a* surrounds the first region $R_1$ of the base portion 11*a*. Therefore, the convex portions 11*b* of the present embodiment are arranged so as to be surrounded by the convex portions 21*b*.

Nevertheless, the convex portions 11*b* and 21*b* of the present embodiment may be arranged in another layout. For example, in the polishing pad dresser 31 of the present embodiment, the first dresser module 31*a* may surround the second dresser module 31*b* as illustrated in FIG. 12B. In this case, the convex portions 11*b* of the present embodiment are arranged so as to surround the convex portions 21*b*.

As described above, the polishing pad dresser 31 of the present embodiment includes the fine and low-density convex portions 11*b* and the coarse and high-density convex portions 21*b*. Therefore, the polishing pad dresser 31 of the present embodiment can realize similar functions to those of the first and second polishing pad dressers 11 and 21 of the first embodiment.

While certain embodiments have been described, these embodiments have been presented by way of example only, and are not intended to limit the scope of the inventions. Indeed, the novel dressers, apparatuses and methods described herein may be embodied in a variety of other forms; furthermore, various omissions, substitutions and changes in the form of the dressers, apparatuses and methods described herein may be made without departing from the spirit of the inventions. The accompanying claims and their equivalents are intended to cover such forms or modifications as would fall within the scope and spirit of the inventions.

The invention claimed is:

1. A polishing pad dresser comprising:

a first base portion;

first convex portions provided in a first region of the first base portion;

a second base portion adjacent to the first base portion; and second convex portions provided in a second region of the second base portion, wherein a width of the first convex portions is 1 to 10 μm, a height of the first convex portions is 0.5 to 10 μm, a density of the first convex portions in the first region is 0.1 to 50%, a width of the second convex portions is greater than 10 μm, and a height of the second convex portions is greater than 10 μm.

2. The dresser of claim 1, wherein the first base portion is configured to be movable relative to the second base portion.

3. The dresser of claim 1, wherein one of the first and second base portions annularly surrounds the other of the first and second base portion.

4. The dresser of claim 1, wherein the second convex portions are formed of diamond.

5. The dresser of claim 1, wherein the first convex portions are formed of a same material as at least a portion of the first base portion.

6. The dresser of claim 1, wherein the first convex portions contain silicon, titanium or aluminum.

7. The dresser of claim 6, wherein the first convex portions are oxide, nitride or carbide containing silicon, titanium or aluminum.

8. The dresser of claim 1, wherein the first and second base portions are configured such that one of the first and second base portions vertically moves relative to the other of the first and second base portions, a lower face of the first convex portions is placed lower than a lower face of the second convex portions when the first base portion moves lower than the second base portion, and the lower face of the second convex portions is placed lower than the lower face of the first convex portions when the second base portion moves lower than the first base portion.

9. A polishing apparatus comprising:

a polishing pad configured to polish a substrate;

a polishing head configured to hold the substrate to bring the substrate into contact with the polishing pad; and a polishing pad dresser including a first base portion, first convex portions provided in a first region of the first base portion, a second base portion adjacent to the first base portion, and second convex portions provided in a second region of the second base portion, and configured to dress the polishing pad with the first and second convex portions, wherein a width of the first convex portions is 1 to 10 μm, a height of the first convex portions is 0.5 to 10 μm, a density of the first convex portions in the first region is 0.1 to 50%, a width of the second convex portions is greater than 10 μm, and a height of the second convex portions is greater than 10 μm.

10. The apparatus of claim 9, wherein the first base portion is configured to be movable relative to the second base portion.

11. The apparatus of claim 9, wherein one of the first and second base portions annularly surrounds the other of the first and second base portion.

12. The apparatus of claim 9, wherein the second convex portions are formed of diamond.

13. The apparatus of claim 9, wherein the first convex portions are formed of a same material as at least a portion of the first base portion.

14. The apparatus of claim 9, wherein the first convex portions contain silicon, titanium or aluminum.

15. The apparatus of claim 14, wherein the first convex portions are oxide, nitride or carbide containing silicon, titanium or aluminum.

16. The apparatus of claim 9, wherein the first and second base portions are configured such that one of the first and second base portions vertically moves relative to the other of the first and second base portions, a lower face of the first convex portions is placed lower than a lower face of the second convex portions when the first base portion moves lower than the second base portion, and the lower face of the second convex portions is placed lower than the lower face of the first convex portions when the second base portion moves lower than the first base portion.

17. A polishing Dad dressing method comprising:

preparing a polishing pad dresser including a first base portion, first convex portions provided in a first region of the first base portion, a second base portion adjacent to the first base portion, and second convex portions provided in a second region of the second base portion, a width of the first convex portions being 1 to 10 μm, a height of the first convex portions being 0.5 to 10 μm, a density of the first convex portions in the first region being 0.1 to 50%, a width of the second convex portions being greater than 10 μm, and a height of the second convex portions being greater than 10 μm, and dressing the polishing pad with the first and second convex portions of the polishing pad dresser.

18. The method of claim 17, wherein the first convex portions of the polishing pad dresser are formed by etching a material of the first convex portions.

19. The method of claim 17, wherein the first convex portions of the polishing pad dresser are formed by metallic molding.

20. The method of claim 17, wherein the first and second base portions are configured such that one of the first and second base portions vertically moves relative to the other of the first and second base portions, a lower face of the first convex portions is placed lower than a lower face of the second convex portions when the first base portion moves lower than the second base portion, and the lower face of the second convex portions is placed lower than the lower face of the first convex portions when the second base portion moves lower than the first base portion.

* * * * *